US010364074B2

(12) United States Patent
Bartow

(10) Patent No.: US 10,364,074 B2
(45) Date of Patent: Jul. 30, 2019

(54) BEVERAGE CONTAINER FINGER RING

(71) Applicant: Douglas Herbert Bartow, Chattanooga, TN (US)

(72) Inventor: Douglas Herbert Bartow, Chattanooga, TN (US)

( * ) Notice: Subject to any disclaimer, the term of this patent is extended or adjusted under 35 U.S.C. 154(b) by 25 days.

(21) Appl. No.: 15/690,000

(22) Filed: Aug. 29, 2017

(65) Prior Publication Data

US 2018/0057227 A1 Mar. 1, 2018

Related U.S. Application Data

(60) Provisional application No. 62/380,921, filed on Aug. 29, 2016.

(51) Int. Cl.
*B65D 51/24* (2006.01)
*B65D 41/32* (2006.01)
*B65D 17/28* (2006.01)

(52) U.S. Cl.
CPC ..... *B65D 51/242* (2013.01); *B65D 17/4012* (2018.01); *B65D 41/32* (2013.01); *B65D 2517/0056* (2013.01); *B65D 2517/0089* (2013.01)

(58) Field of Classification Search
CPC .. B65D 51/24–242; B65D 17/28–4012; B65D 41/32; B65D 2517/0047–0056; B65D 2517/0089; B65D 55/16
USPC ..... 220/375, 265; 215/306
See application file for complete search history.

(56) References Cited

U.S. PATENT DOCUMENTS 3,416,688 A * 12/1968 Fanning ..... A01K 97/04 215/306
3,612,595 A * 10/1971 Updegraff ..... A47J 45/077 215/396
3,904,062 A * 9/1975 Grussen ..... B65D 41/3447 215/252
4,805,792 A * 2/1989 Lecinski, Jr. ..... B65D 41/3447 215/252
5,078,296 A * 1/1992 Amidzich ..... B65D 55/16 220/838
5,360,126 A * 11/1994 Snyder ..... B65D 41/3447 215/252
5,862,929 A * 1/1999 Takeuchi ..... B29C 45/0081 215/384
8,047,387 B2 * 11/2011 Chalekian ..... B65D 51/242 215/200
9,776,779 B2 * 10/2017 Campbell ..... B65D 41/34
9,828,146 B2 * 11/2017 Loukov ..... B65D 41/485
(Continued)

*Primary Examiner* — Kareen K Thomas

(57) ABSTRACT

A beverage container finger ring that allows an individual to easily carry one or multiple beverage container by utilizing only their fingers includes a bottle cap, a bottle carrying ring, a tab, a flexible connector. The tab is adjacently connected to the bottle carrying ring. The bottle carrying ring is adjacently connected to a lateral wall of the bottle cap by the flexible connector so that the bottle carrying ring can be moved in between an opened configuration and a closed configuration. The placement of the bottle carrying ring differentiates multiple embodiments of the beverage container finger ring as the bottle carrying ring can be concentrically positioned to the bottle cap, positioned against the lateral wall from top, and positioned against the lateral wall from bottom with respect to the closed configuration.

8 Claims, 8 Drawing Sheets

(56) References Cited

U.S. PATENT DOCUMENTS

| | | | | |
|---|---|---|---|---|
| 2002/0084240 | A1* | 7/2002 | Yu-Hsien | B65D 23/104<br>215/258 |
| 2005/0035084 | A1* | 2/2005 | Simpson, Jr. | B65D 1/0223<br>215/396 |
| 2006/0124579 | A1* | 6/2006 | Nielson | B65D 23/104<br>215/396 |

* cited by examiner

BEVERAGE CONTAINER FINGER RING

The current application claims a priority to the U.S. Provisional Patent application Ser. No. 62/380,921 filed on Aug. 29, 2016.

FIELD OF THE INVENTION

The present invention relates generally to a beverage container carrying apparatus. More particularly, the present invention is a beverage container finger ring that is integrated onto any beverage container such as a bottle and/or can so that the user can carry the beverage container through the finger ring.

BACKGROUND OF THE INVENTION

Beverage containers such as bottles and/or cans are carried by people holding onto the body of the beverage container or by utilizing a wrapping plastic that combine multiple beverage containers into a single pack. This has been the traditional method of holding beverage containers. Holding a beverage container in this manner can be a tiresome task and also limits the user to only being able to use one hand. Additionally, when people holds onto the body of the beverage containers, it also increases accidental dropping of beverage containers thus damaging the beverage containers. Furthermore, beverage containers also tend to become loss and separate from each other when wrapping plastic is utilized to carry the beverage containers due to the plastic deformation of the wrapping plastic, It is therefore an objective of the present invention to provide a beverage container finger ring which allows the user to carry a beverage container or containers with the use of only one finger. The present invention includes a finger ring that is foldably connected to the beverage container top. In reference to the placement of the finger ring, the user is able to use most of their hand due to the fact that only one finger is used to carry a single beverage container. The finger ring also allows the user to place their beverage container on a hook or other similar means. The finger ring may also be hung or secured to other means such as a keychain freeing both hands of the user. The present invention also allows the user to carry multiple beverage containers with the use of one hand by carrying multiple beverage containers with each finger. The present invention may be applied to any beverage container such as bottles and/or cans.

DETAIL DESCRIPTIONS OF THE INVENTION

All illustrations of the drawings are for the purpose of describing selected versions of the present invention and are not intended to limit the scope of the present invention.

Figure 1:
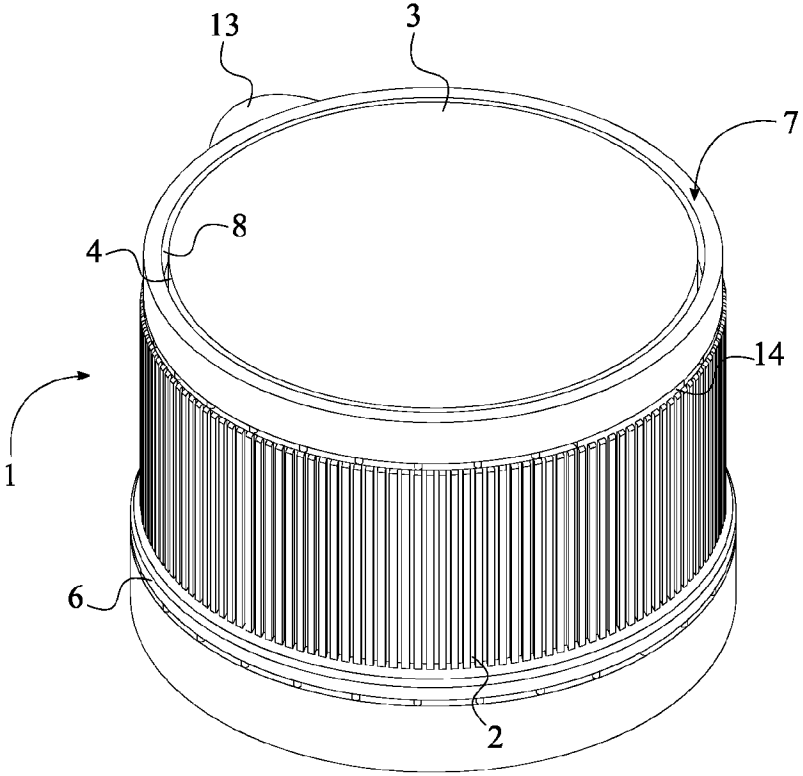
FIG. 1 is a perspective view of the preferred embodiment of the present invention, showing the closed configuration.

The present invention is a beverage container finger ring that allows an individual to easily carry one or multiple beverage container by utilizing only one or more fingers. More specifically, unique component configuration of the present invention enables an individual to carry a single beverage container with one of their fingers, enabling multiple fingers to carry multiple beverage containers. The present invention comprises a bottle cap 1, a bottle carrying ring 7, a tab 13, and a flexible connector 14 as shown in FIG. 1. In reference to the general configuration of the present invention, the tab 13 is adjacently connected to the bottle carrying ring 7. The bottle carrying ring 7 is adjacently connected to a lateral wall 2 of the bottle cap 1 by the flexible connector 14 so that the bottle carrying ring 7 can be moved in between an opened configuration and a closed configuration by utilizing the tab 13.

The bottle cap 1, which functions similar to regular bottle cap 1, comprises a top portion 3 and a bottom rim 6 in addition to the lateral wall 2. As shown in FIG. 1, the lateral wall 2 is perimetrically connected around the bottom rim 6 thus delineating an annular shape sleeve for the bottle cap 1. The top portion 3 is perimetrically connected around the lateral wall 2 and oppositely positioned of the bottom rim 6. In other words, the bottom rim 6 and the top portion 3 are terminally connected to the lateral wall 2. The top portion 3 that is shaped similar to an annular disk closes the annular shape sleeve so that the bottle cap 1 is able to delineate an opening through the bottom rim 6 and within the lateral wall 2. Resultantly, the opening can couple with a neck of the beverage container encircling a neck opening of the beverage container.

Figure 2:
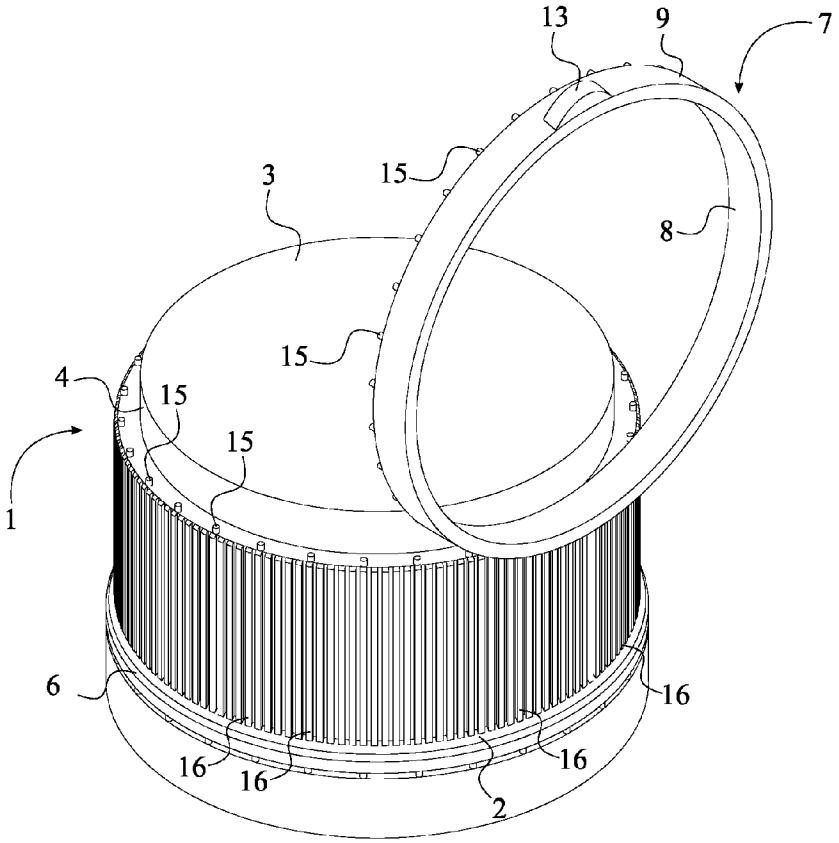
FIG. 2 is a perspective view of the preferred embodiment of the present invention, showing the opened configuration.

In reference to FIG. 2, the present invention can further comprise a plurality of ridges 16 that is radially connected around the lateral wall 2. More specifically, the plurality of ridges 16 extends from the bottom rim 6 to the top portion 3 to increase friction between the lateral wall 2 and the user's hand. As a result, the user is able to securely and firmly grip the bottle cap 1 during opening and closing of the beverage container. However, the present invention is not limited the plurality of ridges 16 and can utilize be any other types of means or apparatus that increases the fiction between the lateral wall 2 and the user's hand.

The bottle carrying ring 7 comprises a finger receiving opening and a body. The finger receiving opening is traversed through the body so that the bottle carrying ring 7 enables the user to insert their finger through the finger receiving opening in order to carry the beverage container. The bottle carrying ring 7 is preferably shaped to an annular shape eliminating any shape edges that may provide uncomfortable pressure to user's finger. The positioning and the structural configuration of the bottle carrying ring 7 are slightly different from one embodiment to another embodiment of the present invention as each embodiment illustrates a different variation of the present invention. Additionally, the bottle carrying ring 7 is mounted to the bottle cap 1 by a plurality of breakable mounts 15 thus delineating the closed configuration of the present invention. When pressure is applied to the bottle carrying ring 7 through the tab 13, the plurality of breakable mounts 15 is separated from each other thus allowing the bottle carrying ring 7 to move from the closed configuration to the opened configuration.

Figure 3:
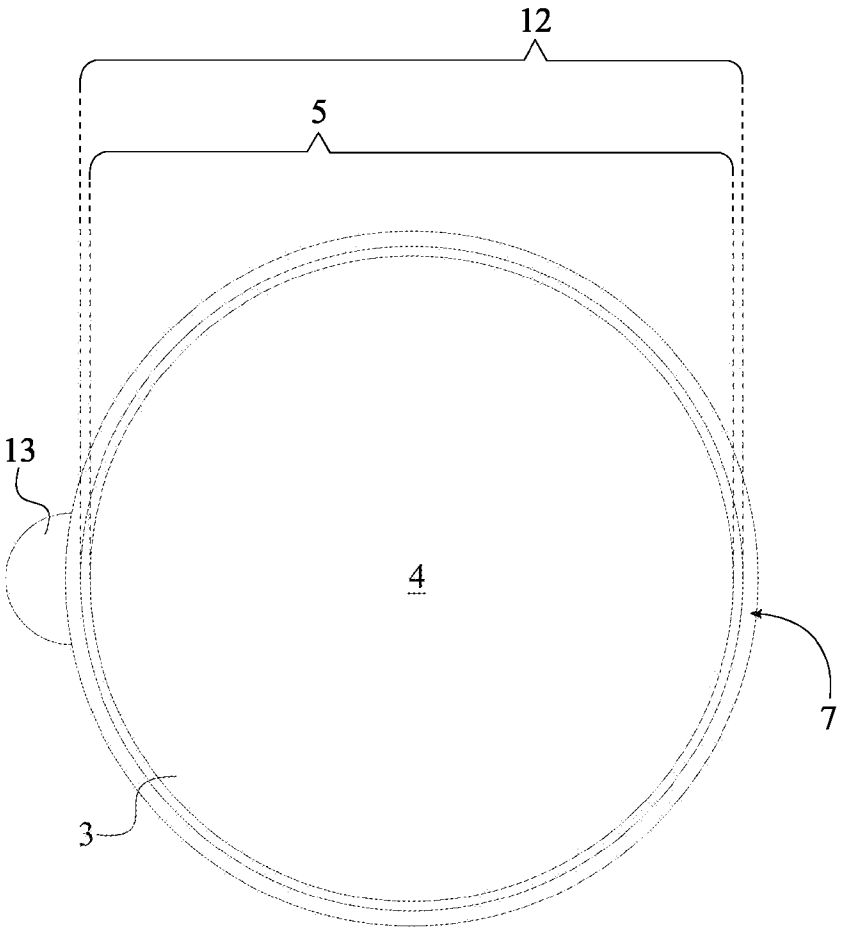
FIG. 3 is a top view of the preferred embodiment of the present invention.

In reference to FIG. 1-3, which illustrates a preferred embodiment of the present invention, the bottle carrying ring 7 is a rigid body. More specifically, the bottle carrying ring 7 is concentrically positioned around the top portion 3 in such a way that an inner surface 8 of the bottle carrying ring 7 is adjacently positioned around an outer surface 4 of the top portion 3. In other words, an inner diameter 12 of the bottle carrying ring 7 is slightly greater than an outer diameter 5 of the top portion 3 so that the bottle carrying ring 7 can be snuggly fitted around the top portion 3 as shown in FIG. 3. An outer surface 9 of the bottle carrying ring 7 is connected to the lateral wall 2 by the flexible connector 14, enabling the movement between the opened configuration and the closed configuration. The tab 13 is adjacently connected to the outer surface 9 of the bottle carrying ring 7, wherein the tab 13 is diametrically opposed from the flexible connector 14. The tab 13 provides an overhanding platform with respect to the bottle carrying ring 7 so that the user can apply pressure to open or close the bottle carrying ring 7. Additionally, the plurality of breakable mounts 15 is radially distributed around the bottle carrying ring 7 so that the bottle carrying ring 7 can be concentrically mounted to the lateral wall 2 by the plurality of breakable mounts 15. When the bottle carrying ring 7 is laid down directly around the top portion 3, the preferred embodiment delineates the closed configuration. When the bottle carrying ring 7 is lifted perpendicular to the top portion 3 through the flexible connector 14, the preferred embodiment delineates the opened configuration.

In reference to FIG. 4-FIG. 7, which illustrates a first alternating embodiment and a second alternating embodiment of the present invention, the bottle carrying ring 7 is a foldable body that is positioned around the lateral wall 2 and comprises a first malleable section 10 and a second malleable section 11. More specifically, the first malleable section 10 is radially positioned around the lateral wall 2 as the first malleable section 10 adjacently connects to the lateral wall 2 by the flexible connector 14. The second malleable section 11 is radially positioned around the first malleable section 10, opposite of the lateral wall 2, so that the second malleable section 11 can be terminally connected to the first malleable section 10. The tab 13, which allows the user to operate the bottle carrying ring 7, is adjacently connected to the second malleable section 11. Due to the positioning of the first malleable section 10 and the second malleable section 11, the tab 13 is adjacently positioned to the flexible connector 14 during the closed configuration. Additionally, the plurality of breakable mounts 15 is radially distributed around the first malleable section 10 so that the bottle carrying ring 7 can be concentrically mounted to the lateral wall 2 through the plurality of breakable mounts 15. When the bottle carrying ring 7 is pressed against the lateral wall 2, the first alternating embodiment and the second alternating embodiment delineate the closed configuration. When the bottle carrying ring 7 is extended away from the lateral wall 2, the first malleable section 10 and the second malleable section 11 form a circular shape member as the first alternating embodiment and the second alternating embodiment delineate the opened configuration.

Figure 4:
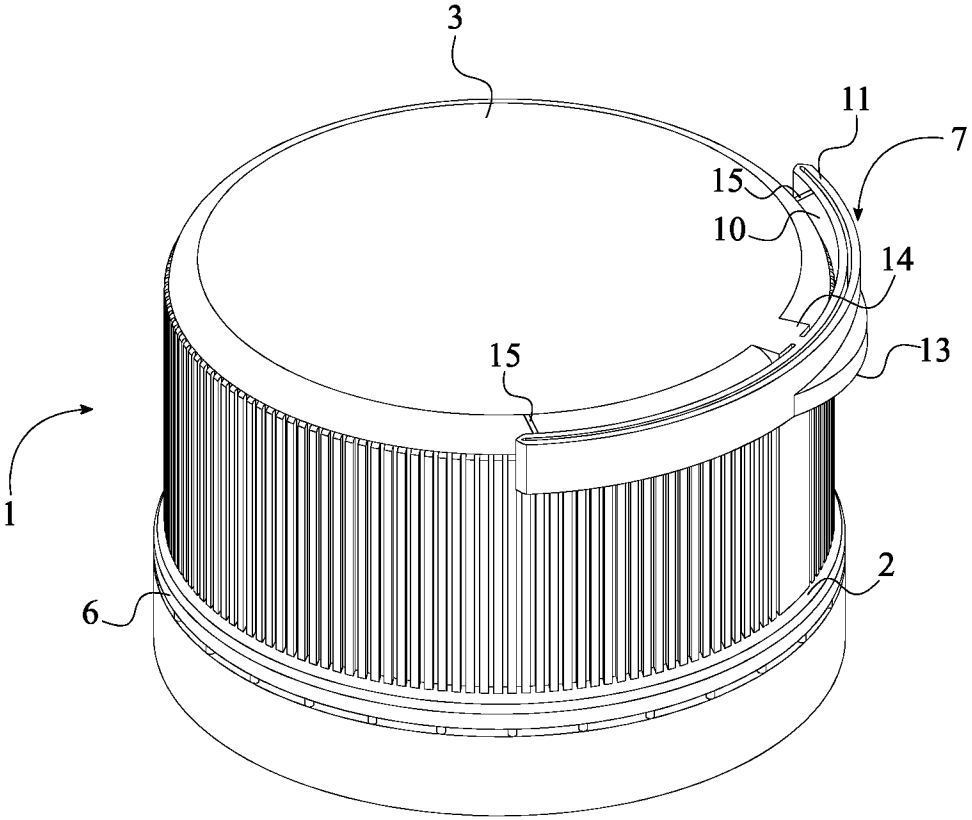
FIG. 4 is a perspective view of the first alternating embodiment of the present invention, showing the closed configuration.
Figure 5:
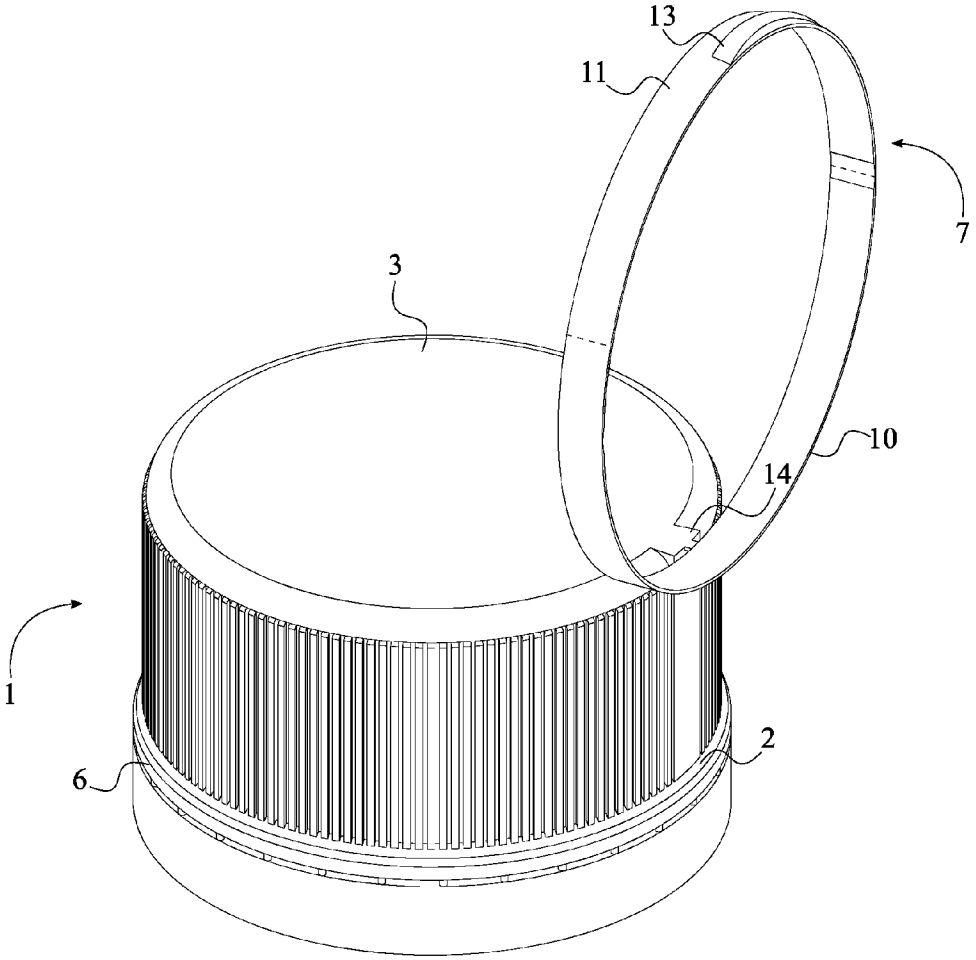
FIG. 5 is a perspective view of the first alternating embodiment of the present invention, showing the opened configuration.

The first alternating embodiment of the present invention is illustrated in FIG. 4-5 as the first malleable section 10 and the second malleable section 11 are adjacently positioned to the top portion 3. Resultantly, the bottle carrying ring 7 moves in between the opened configuration and the closed configuration about the top portion 3.

Figure 6:
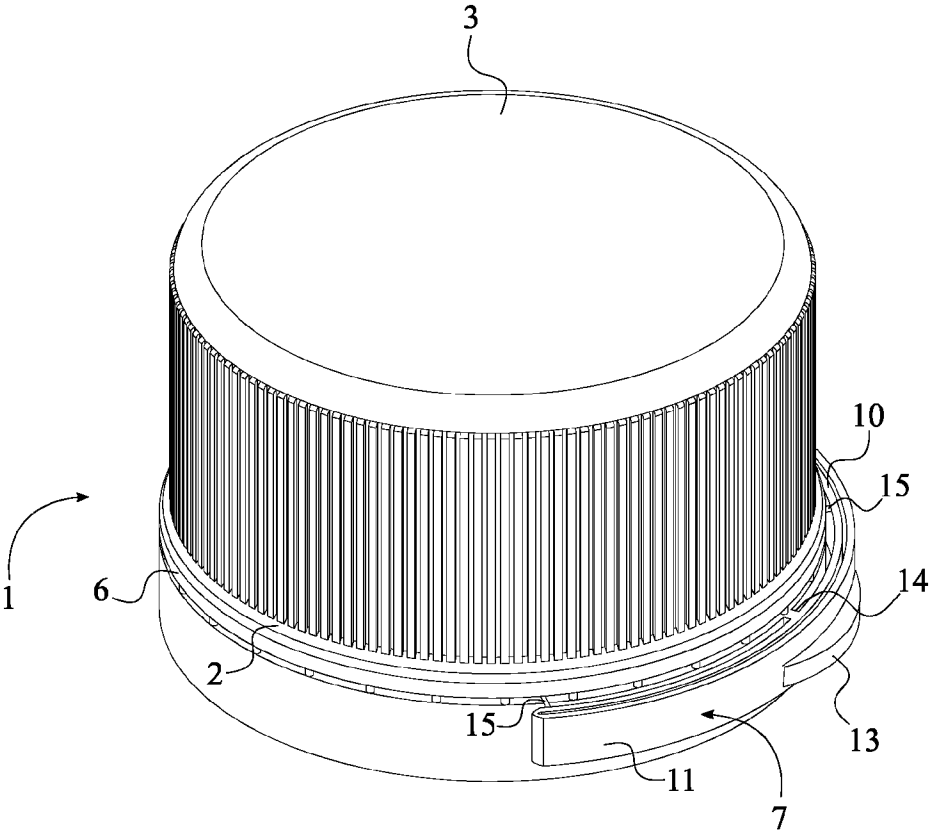
FIG. 6 is a perspective view of the second alternating embodiment of the present invention, showing the closed configuration.
Figure 7:
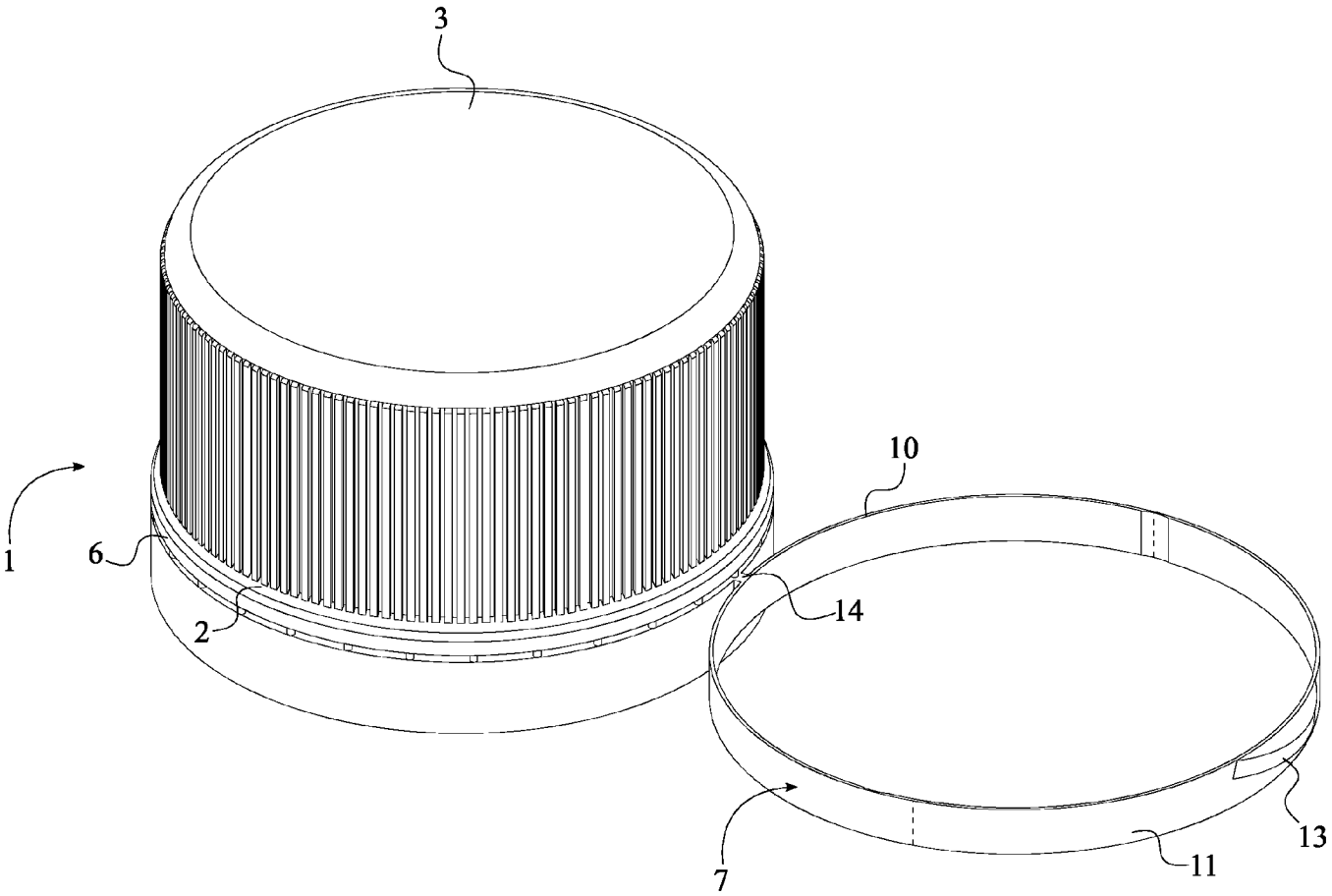
FIG. 7 is a perspective view of the second alternating embodiment of the present invention, showing the opened configuration.

The second alternating embodiment of the present invention is illustrated in FIG. 6-7 as the first malleable section 10 and the second malleable section 11 are adjacently positioned to the bottom rim 6. Resultantly, the bottle carrying ring 7 moves in between the opened configuration and the closed configuration about the bottom rim 6.

Figure 8:
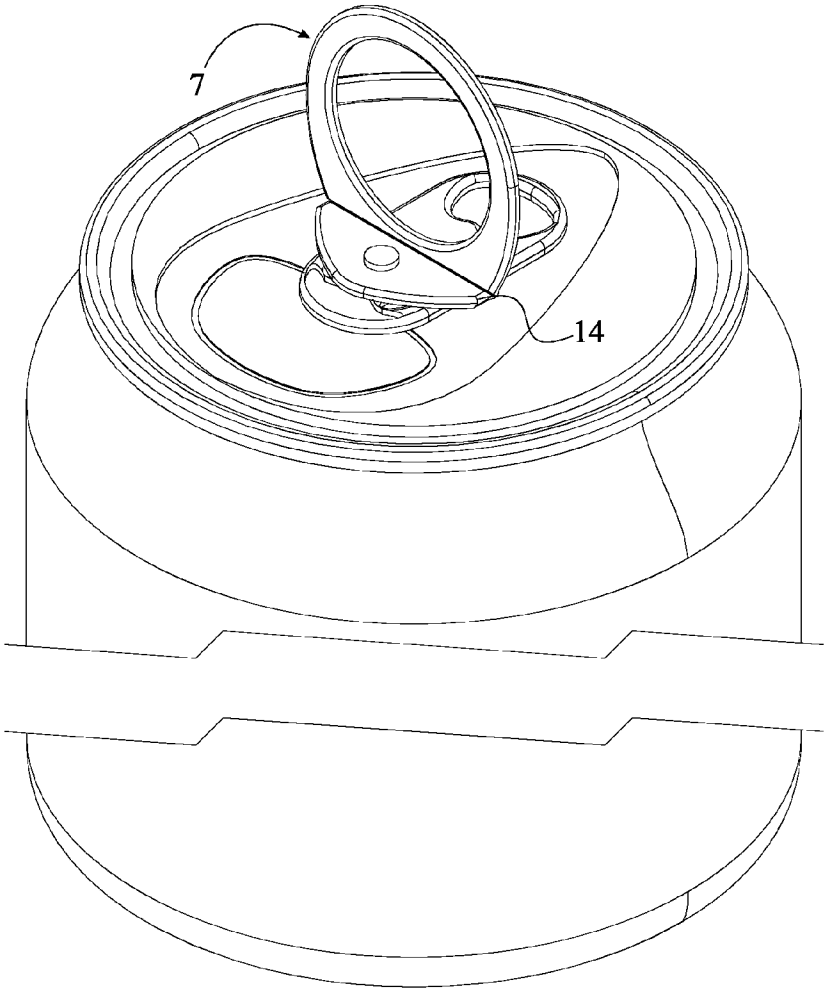
FIG. 8 is a perspective view of the fourth alternating embodiment of the present invention.

In reference to FIG. 8, which illustrates a fourth alternating embodiment of the present invention, the bottle carrying ring 7 is positioned on top of a beverage can. A pin piece of the beverage can, which secures a pull tab of the beverage can, is modified to extend the height of the pin piece further out from the beverage can. The bottle carrying ring 7 is secured to the beverage can by the pin piece and the flexible connector 14 so that the bottle carrying ring 7 can be operated completely independent from the pull tab. The flexible connector 14 of the fourth alternative embodiment is a rectangular hinge member. More specifically, the bottle carrying ring 7 is terminally connected to a first end of the flexible connector 14 while a second end of flexible connector 14 is mounted to the pull tab 13 through the pin piece, in a hinged fashion. As a result, the bottle carrying ring 7 may be laid down directly on top of the beverage can to delineate the closed configuration or lifted perpendicular to the top of the beverage can through the flexible connector 14 to delineate the opened configuration.

Due to the fact that the bottle carrying ring 7 being mounted to the bottle cap 1, the present invention minimizes the re-tooling during manufacturing process. Additionally, the placement of the present invention does not interfere with the seal of the beverage container. As a result, the present invention can be utilized to carry beverage containers without scarifying the structural integrity of the seal. Furthermore, the present invention can eliminate traditional wrapping plastics such as plastic yokes and cardboard boxes that can increase or assist environmental pollution and threaten wildlife population.

Although the invention has been explained in relation to its preferred embodiment, it is to be understood that many other possible modifications and variations can be made without departing from the spirit and scope of the invention as hereinafter claimed.

What is claimed is:

1. A beverage container finger ring comprises:

a bottle cap;

a bottle carrying ring;

a tab;

a flexible connector;

the tab being adjacently connected to the bottle carrying ring;

the bottle carrying ring being adjacently connected to a lateral wall of the bottle cap by the flexible connector;

the bottle cap comprises a top portion and a bottom rim;

the lateral wall being perimetrically connected around the bottom rim; and the top portion being perimetrically connected around the lateral wall, opposite of the bottom rim.

2. The beverage container finger ring as claimed in claim 1 comprises:

the bottle carrying ring being concentrically positioned around the top portion;

an inner surface of the bottle carrying ring being adjacently positioned around an outer surface of the top portion;

an outer surface of the bottle carrying ring being connected to the lateral wall by the flexible connector;

the tab being adjacently connected to the outer surface of the bottle carrying ring; and the tab and the flexible connector being diametrically opposed of each other.

3. The beverage container finger ring as claimed in claim 2, wherein an inner diameter of the bottle carrying ring being greater than an outer diameter of the top portion.

4. The beverage container finger ring as claimed in claim 2 comprises:

a plurality of breakable mounts;

the plurality of breakable mounts being radially distributed around the bottle carrying ring; and the bottle carrying ring being concentrically mounted to the lateral wall by the plurality of breakable mounts.

5. The beverage container finger ring as claimed in claim 1 comprises:

the bottle carrying ring comprises a first malleable section and a second malleable section;

the first malleable section being radially positioned around the lateral wall;

the first malleable section being adjacently connected to the lateral wall by the flexible connector;

the second malleable section being radially positioned around the first malleable section, opposite of the lateral wall;

the second malleable section being terminally connected to the first malleable section;

the tab being adjacently connected to the second malleable section; and the tab being adjacently positioned to the flexible connector.

6. The beverage container finger ring as claimed in claim 5 comprises:

a plurality of breakable mounts;

the plurality of breakable mounts being radially distributed around the first malleable section; and the first malleable section being concentrically mounted to the lateral wall by the plurality of breakable mounts.

7. The beverage container finger ring as claimed in claim 5, wherein the first malleable section and the second malleable section being adjacently positioned to a top portion of the bottle cap.

8. The beverage container finger ring as claimed in claim 5, wherein the first malleable section and the second malleable section being adjacently positioned to a bottom rim of the bottle cap.

* * * * *